US006516574B1

(12) United States Patent
Couture

(10) Patent No.: US 6,516,574 B1
(45) Date of Patent: Feb. 11, 2003

(54) MODULAR STAIRWAY SYSTEM, METHOD FOR ERECTING STAIRWAY AND KIT THEREFOR

(75) Inventor: Raymond Couture, Bromont (CA)

(73) Assignee: Stairframe Systems Inc., La Prairie (CA)

( * ) Notice: Subject to any disclaimer, the term of this patent is extended or adjusted under 35 U.S.C. 154(b) by 0 days.

(21) Appl. No.: 09/343,252

(22) Filed: Jun. 30, 1999

(30) Foreign Application Priority Data

Jun. 30, 1998 (CA) ..... 2242057

(51) Int. Cl.[7] ..... E04F 11/00

(52) U.S. Cl. ..... 52/182; 52/183; 52/188; 52/191; 52/184; 52/186

(58) Field of Search ..... 52/182, 183, 188, 52/191, 184, 186

(56) References Cited

U.S. PATENT DOCUMENTS

| | | | | |
|---|---|---|---|---|
| 1,474,850 A | | 11/1923 | Rudloff | |
| 2,206,862 A | * | 7/1940 | Boyd | 52/188 |
| 3,706,170 A | * | 12/1972 | Argraves et al. | 52/189 |
| 4,034,525 A | * | 7/1977 | Yokomori | 52/188 |
| 4,783,939 A | * | 11/1988 | Bergmann et al. | 52/188 |
| 4,832,106 A | | 5/1989 | Short | |
| 5,636,483 A | * | 6/1997 | Wille | 52/188 |
| 5,660,009 A | | 8/1997 | Cousin | |
| 6,088,976 A | * | 7/2000 | Roy | 52/179 |
| 6,088,977 A | * | 7/2000 | Lawrence | 52/182 |

FOREIGN PATENT DOCUMENTS

| | | |
|---|---|---|
| CA | 2149981 | 11/1995 |
| DE | 26 23 484 | 12/1977 |
| FR | 2 390 564 | 12/1978 |
| WO | WO 89/02506 | 3/1989 |
| WO | WO 98/54422 | 12/1998 |

* cited by examiner

*Primary Examiner*—Lanna Mai
*Assistant Examiner*—Dennis L. Dorsey
(74) *Attorney, Agent, or Firm*—Swabey Ogilvy Renault

(57) ABSTRACT

The present staircase includes a permanent framing made of metallic stringers, one of which being typically secured to a half-timbering. vertically extending step supports are secured along the stringers and each include upper and front flanges adapted to be secured respectively to a tread and to a riser of each step of the staircase. A temporary staircase may be easily obtained with the present kit for use during construction, wherein a number of L-shaped steel step units are laid onto the step supports to form a successive series of alternating risers and treads. Then, these L-shaped steel units can be removed and replaced by finished steps of various configurations. If the staircase has an exposed side, a finishing stringer is provided thereat to conceal the structural metallic stringer. Various support systems, including corner posts and brackets, are provided for supporting various horizontal and vertical structural components of the framework of the staircase, including when the staircase is L-shaped or U-shaped thereby including a turn in the staircase with flaring steps, and also possibly a landing.

25 Claims, 18 Drawing Sheets

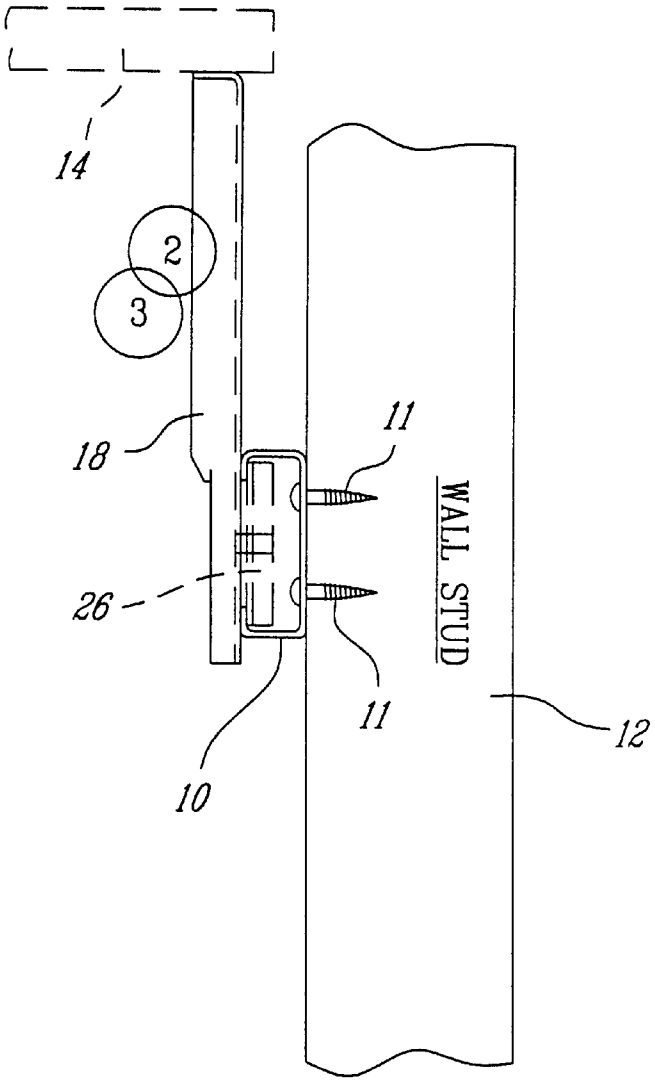
FIG. 3
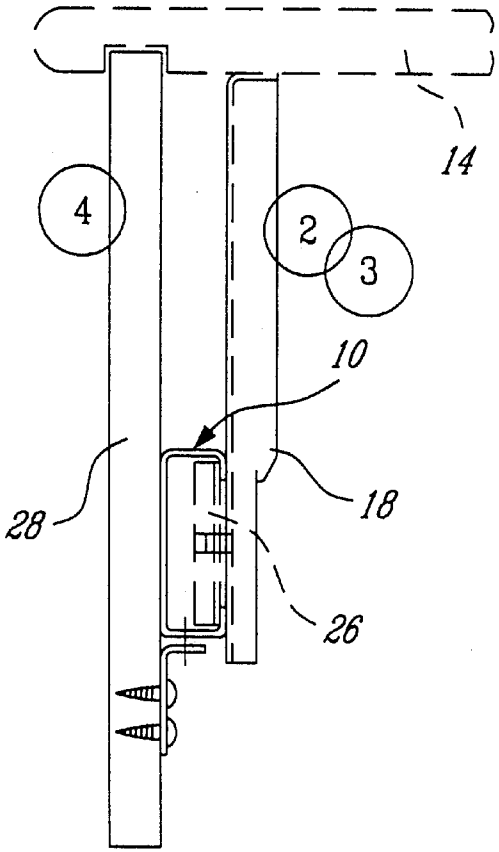

14
16
42
38
20
9"
A
10
24
22
6 1/2
18
40
B
26
28

UP
103
104
105
1
2
3
A
B
9
10
11
12
13
14
52
54
56
58
60
62
64

MODULAR STAIRWAY SYSTEM, METHOD FOR ERECTING STAIRWAY AND KIT THEREFOR

BACKGROUND OF THE INVENTION

1. Field of the Invention

The present invention relates to staircases and, more particularly, to a staircase made of premeasured components for partial or complete assembly thereof in the plant or, in the form of a kit, for assembly on site.

2. Description of the Prior Art

Typically, staircases are completely produced on site with the various wood components being cut to size as the staircase is progressively erected on site. Furthermore, the finishing of a staircase is often damaged during construction, namely the carpeting which covers the steps or the solid wood finishing thereof. It is virtually impossible to defer the installation of the finishing covering of the steps of the staircase until the end of the construction thereby resulting in damages to this finishing during the final stages of the construction.

Also, it has been proposed to completely assemble a staircase in the factory such that a pre-assembled staircase is delivered to the construction site for direct and easy installation thereat. Such a modular staircase is disclosed in the present inventor's co-pending Canadian Application No. 2,149,981 which was laid-open for public inspection on Nov. 24, 1995. In such a case, a modular staircase without its finishing covering is delivered on site and installed thereat. Once the finishing covering, e.g. carpeting, solid wood, etc. has been installed on the staircase, it might again be subject to damage before the construction process is completely finished.

SUMMARY OF THE INVENTION

It is therefore an aim of the present invention to provide a novel staircase made of individual components manufactured to size in plant which, in the form of a kit, can be assembled together and installed on site or which can be mostly assembled together in plant and then installed on site.

It is also an aim of the present invention to provide a staircase having temporary steps for use during construction, which are then replaced by permanent steps.

Therefore, an accordance with the present invention, there is provided a staircase system, comprising at least two stringer means and at least first temporary and second finished sets of step means, each step means including at least tread means, said stringer means being adapted for supporting said step means and being detachably attached thereto, wherein during construction said first set of step means are temporarily attached to said stringer means, whereas at the end of construction said first set of step means are replaced by said second set of step means which are secured to said stringer means.

Also in accordance with the present invention, there is provided a modular framework for a staircase, comprising at least two non-wooden stringers and a series of non-wooden step supports adapted to be mounted to the stringers for supporting a number of steps when the stringers are installed in a dwelling, wherein said step supports are installed to said stringers at predetermined locations there along such that the steps can be directly mounted to said step supports and into proper position thereof for the staircase.

Further in accordance with the present invention, there is provided a kit for erecting a staircase in a dwelling, comprising at least two stringers, a series of step supports adapted to be mounted to the stringers, and at least a first set of steps adapted to be mounted to said step supports when said stringers and said step supports are installed in a dwelling, wherein said step supports are installed to said stringers at predetermined locations there along such that the steps can be directly mounted to said step supports and into proper position thereof for the staircase.

Still further in accordance with the present invention, there is provided a method of erecting a staircase in a dwelling, comprising the steps of:

a) providing at least two stringers and first temporary and second finished sets of steps;

b) installing said stringers to a framework of the dwelling;

c) mounting the temporary set of steps to the stringers;

d) removing the temporary set of steps from the stringers at the end of a construction process; and e) mounting the finished set of steps to the stringers.

BRIEF DESCRIPTION OF THE DRAWINGS

Having thus generally described the nature of the invention, reference will now be made to the accompanying drawings, showing by way of illustration a preferred embodiment thereof, and in which:

FIG. 3 is a schematic front elevational view, partly broken away, of the staircase of FIG. 2;

FIG. 8 is a top plan view of the angular section of the staircase and schematically showing the support of FIG. 7 and various brackets used in the support frame of the angular section of the staircase;

DESCRIPTION OF THE PREFERRED EMBODIMENTS

Figure 6:
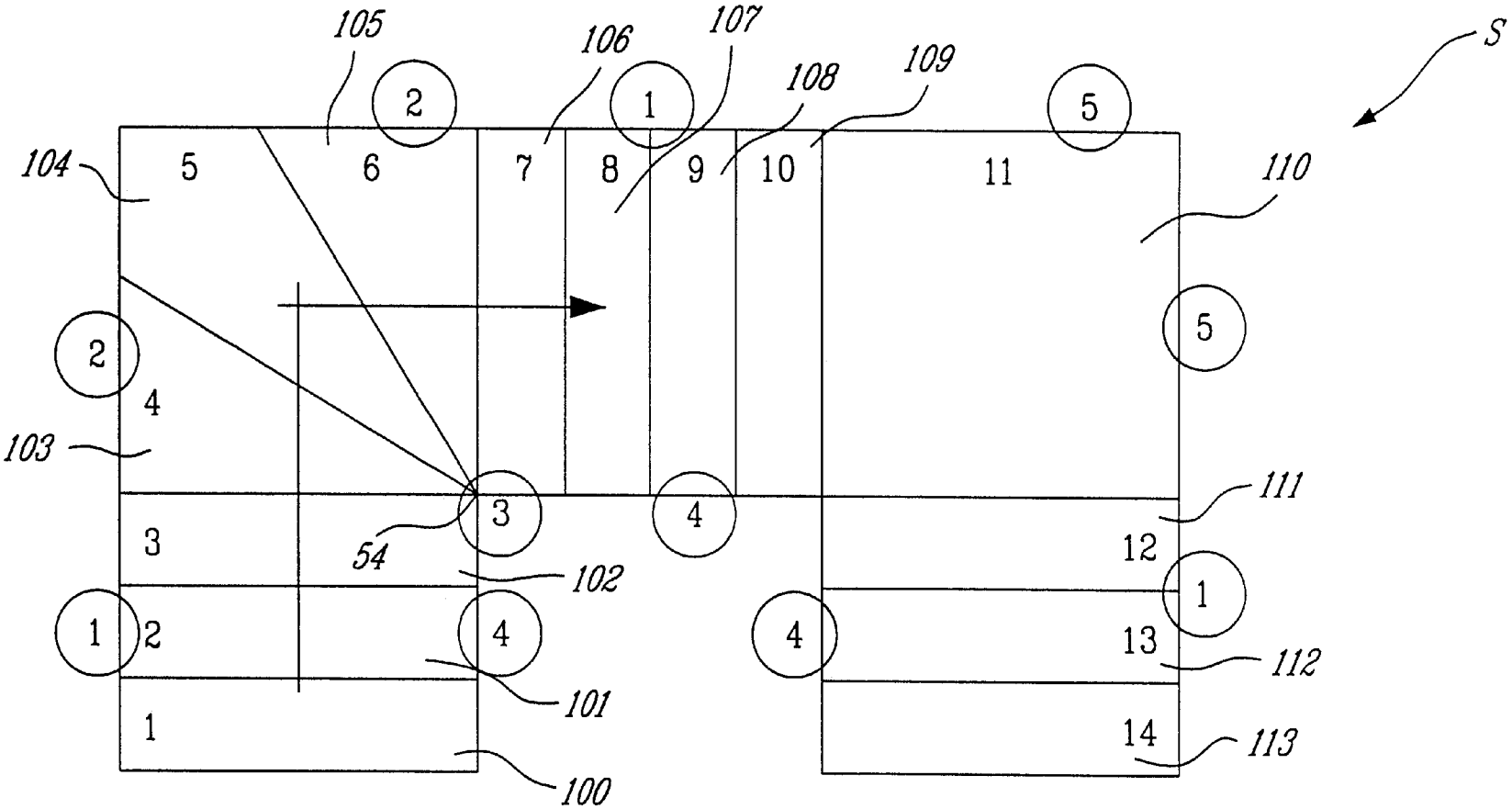
FIG. 6 schematic top plan view of a staircase in accordance with the present invention.

FIG. 6 shows a top plan view of a staircase S in accordance with the present invention, wherein, from the ground up, there are three straight steps 100, 101 and 102, followed by an angular section of the staircase S including flaring steps 103, 104 and 105. Then, the staircase S includes four straight steps 106, 107, 108 and 109, followed by a landing 110, and then by three straight steps 111, 112 and 113.

Figure 2:
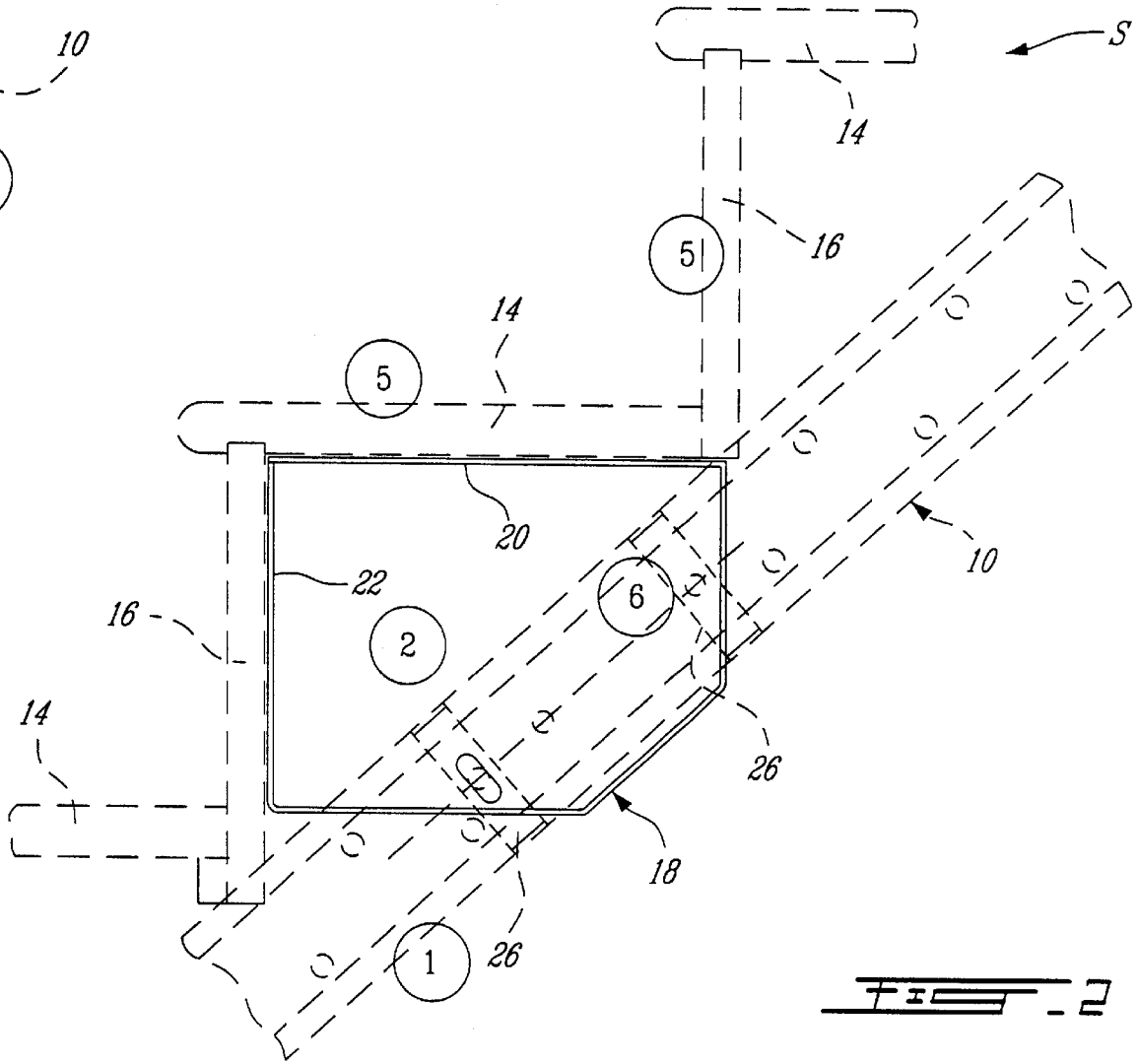
FIG. 2 is a schematic side elevational view similar to FIG. 1 but showing the staircase in a second state thereof.

Now referring to FIG. 2, a steel C-shaped stringer 10 is used on each side of the staircase S, the stringers 10 being attached with screws 11 to structural wooden components, such as half-timberings, in the form of a wall stud 12 in FIG. 3. The angle of the stringers 10 is governed by the height of the risers of the staircase S.

Figure 4:
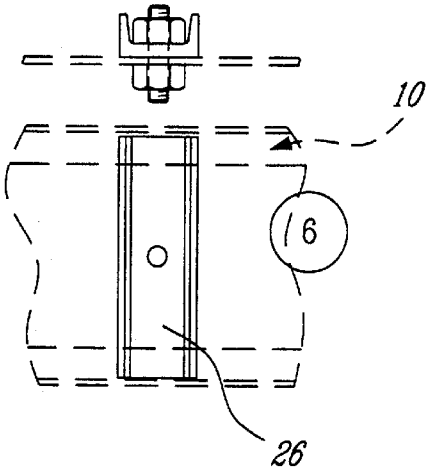
FIG. 4 is a detailed view of the sliding anchor for adjustable step support of FIG. 2.
Figures 5, 5A, 5B:
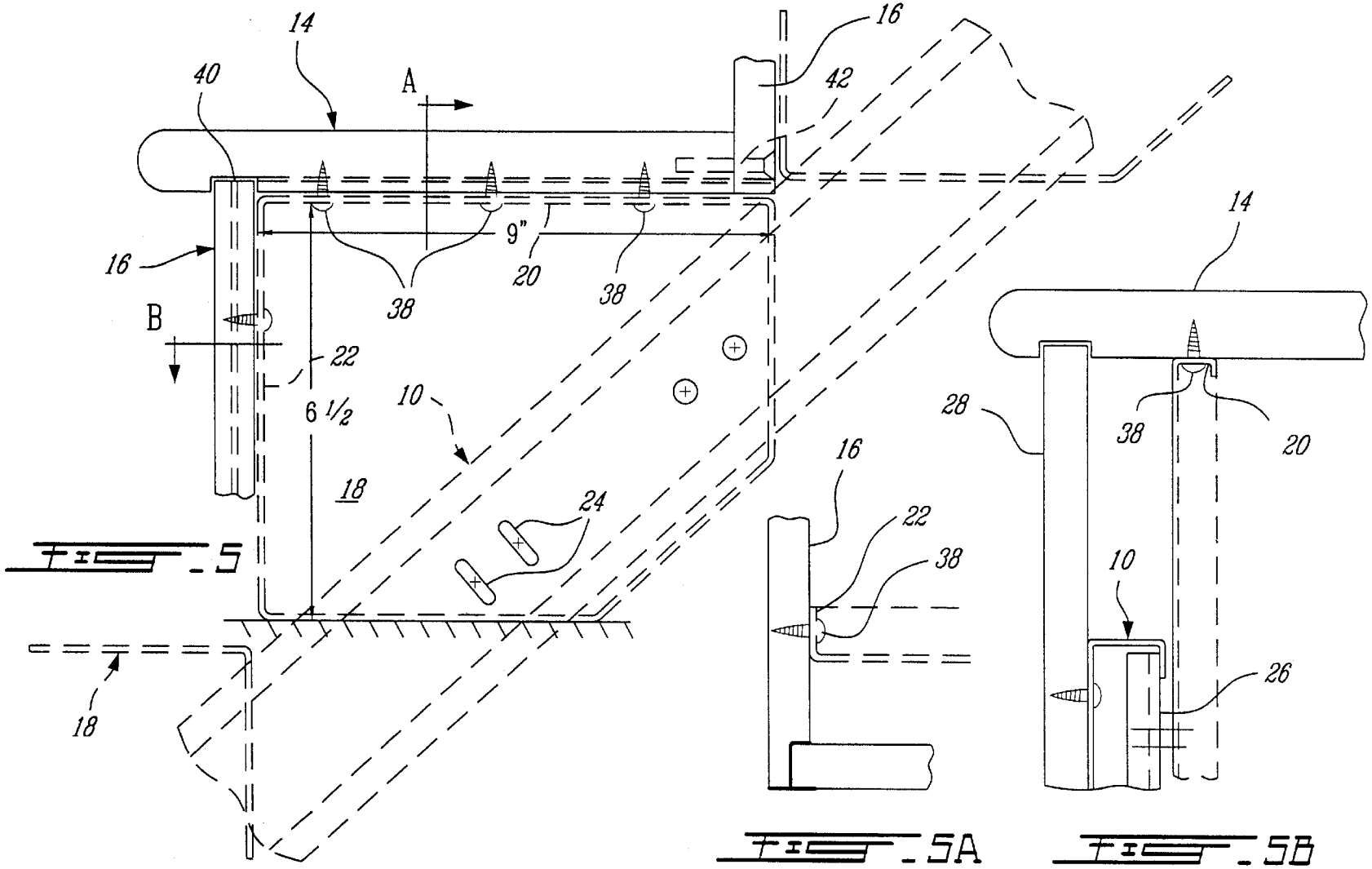
FIG. 5 is a schematic side elevational view similar to FIG. 2 and showing details of the assembly of the risers and the steps to the step support attached to the stringers.
FIG. 5A is a cross-sectional view taken along section line A of FIG. 5.
FIG. 5B is a cross-sectional view taken along section line B of FIG. 5.

The staircase S also includes successive steps 14 (also called treads) and risers 16. To attach the steps 14 and the risers 16 to the stringers 10, there are provided for each riser 16 and step 14 located thereabove an adjustable step support 18 in the form of a metallic plate defining planar upper and front perpendicular flanges 20 and 22 adapted to respectively abut the step 14 and the riser 16 and to be attached thereto, as seen in FIGS. 2 and 5. Angled oblong openings 24 are defined in one of the stringers 10 and the step support 18 to allow for the relative positioning of the step support 18 with respect to the stringer 10 such that a same step support 18 can be used with risers 16 of different heights and steps 14 of different depth. More particularly, a slidable anchor 26 (see FIGS. 2 and 4) allows for the step support 18 to be adjusted with respect to the stringers 10.

Figure 1:
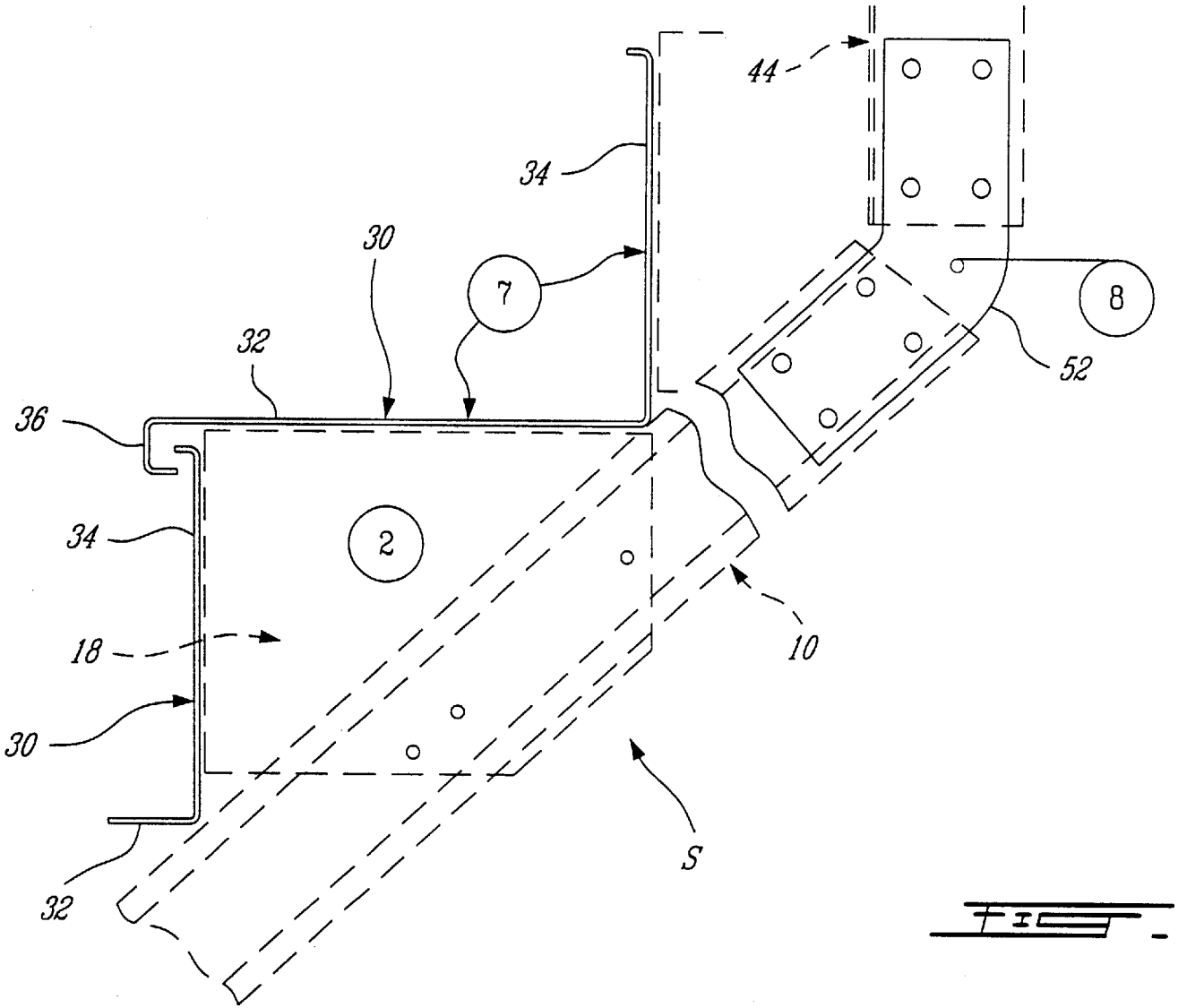
FIG. 1 is a schematic side elevational view of a staircase in accordance with the present invention shown in a first state thereof.

As seen in FIG. 3, a finished stringer covering 28 is provided on the staircase S to provide an esthetic finishing to the exposed side of the staircase S, that is the side thereof which is visible and thus opposed to the side anchored to the wall stud 12, in the case of staircases having one such exposed side, In FIG. 2, the staircase S is shown in its finished state, that is with esthetic and quality steps and risers 14 and 16. However, the present modular staircase S has further use in that the finished steps and risers 14 and 16 can be only installed to the step support 18 after the construction has been completed. During construction, the steps and risers 14 and 16 are replaced by temporary steel steps and risers which take the form, as seen in FIG. 1, of a series of successive L-shaped units 30, each including a horizontal section 32 which acts as a step and a vertical section 34 which acts as a riser, the front edge of the horizontal section 32 defining an inturned lip 36. These L-shaped units 30 are temporarily secured to the steps support 18 such that the staircase s can be used during construction without causing damage thereto. After the construction has been terminated, the L-shaped units 30 are replaced by finished steps 14 and risers 16 (see FIG. 2). Therefore, the staircase S takes the form of a kit which, in its simplest form, includes the stringers 10, the adjustable step support 18, the temporary L-shaped step units 30 and the finished steps 14 and risers 16.

As seen in FIG. 5, the upper and front flanges 20 and 22 of the step support 18 are secured respectively to the steps 14 and risers 16 by a series of screws 38 which extend through the flanges 20 and 22 and into the steps 14 and risers 16 from the blind sides thereof. Sections A and B of FIGS. 5A and 5B show these screws 38 extending through the flanges 20 and 22 of the step support 18. Adhesive 40 may be used to secure the upper end of the riser 16 to the lower front end of the step 14. Also, the lower end of the riser 16 may be secured to the rear end of the step 14 by way of an appropriate resin 42, such as a polyester-based resin which, once hardened, "welds" the wooden components together as described in details in aforementioned Canadian Application No. 2,149,981.

Figure 7A:
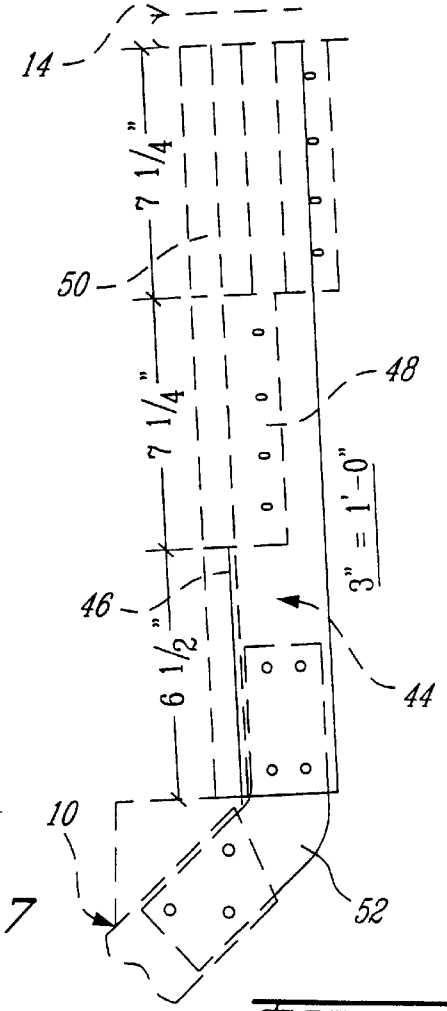
FIG. 7A schematic elevational view of the support of FIG. 7.
Figure 7:
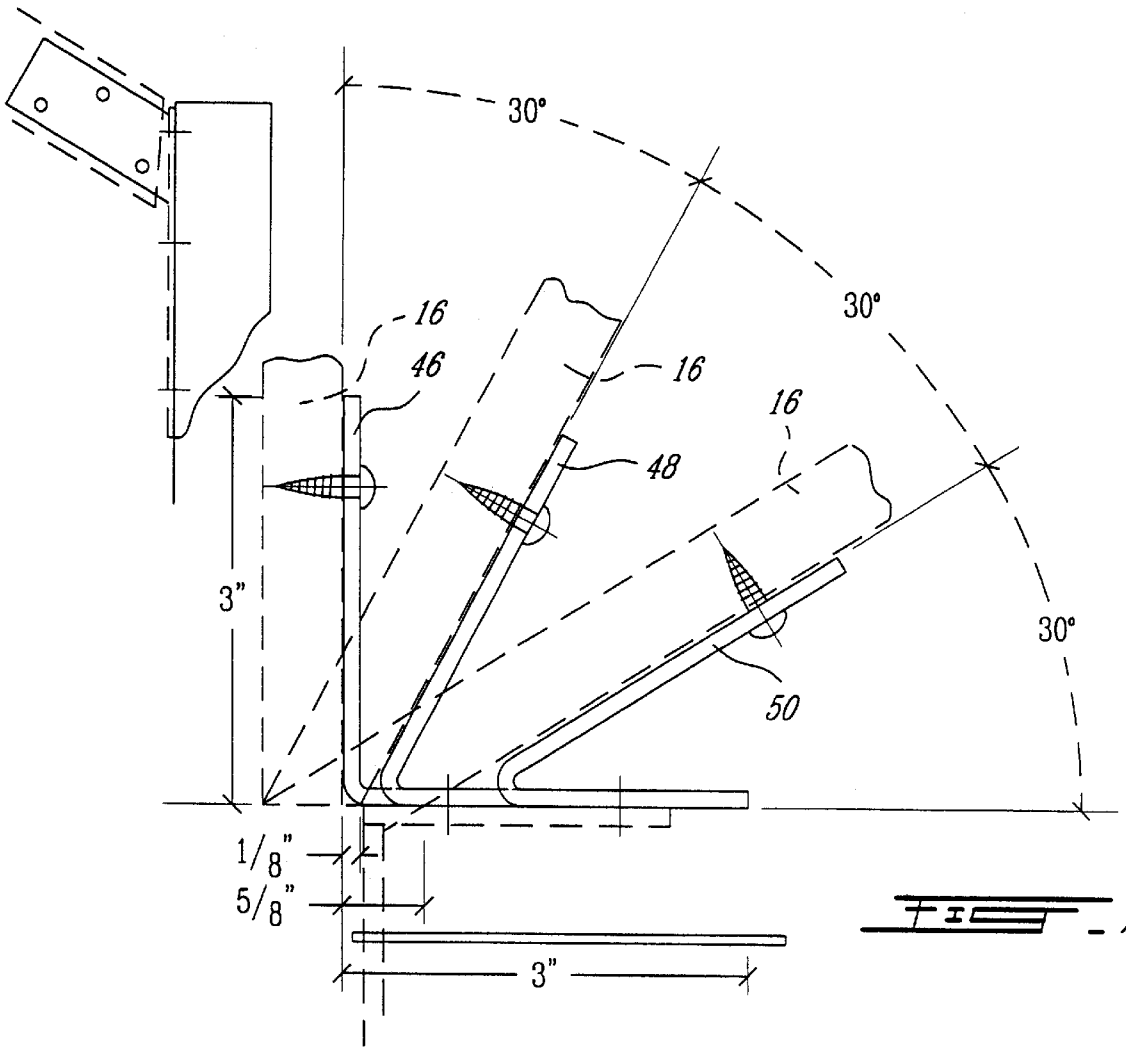
FIG. 7 schematic top plan view of a support for an angular section of the staircase.

The present invention also provides for various structural components for providing support to the staircase S. For instance, a support post 44, shown in FIG. 7A, is used to support the converging ends of steps 103, 104 and 105 of the angular section of the staircase S (see FIG. 6). The vertical post 44 includes three support plates extending at different angles therefrom, namely a lower support plate 46, an intermediate support plate 48 and an upper plate support plate 50 adapted to be attached to different risers for respectively supporting steps 103, 104 and 105. The lower end of the corner post 44 includes a connecting plate 52 for attachment to a lower stringer 10, as seen in FIGS. 1 and 7A. With reference to FIG. 6, the support plates 46, 48 and 50 of the corner post 44 are generally located at 54.

Figures 8A, 8B, 8C, 8D, 8E:
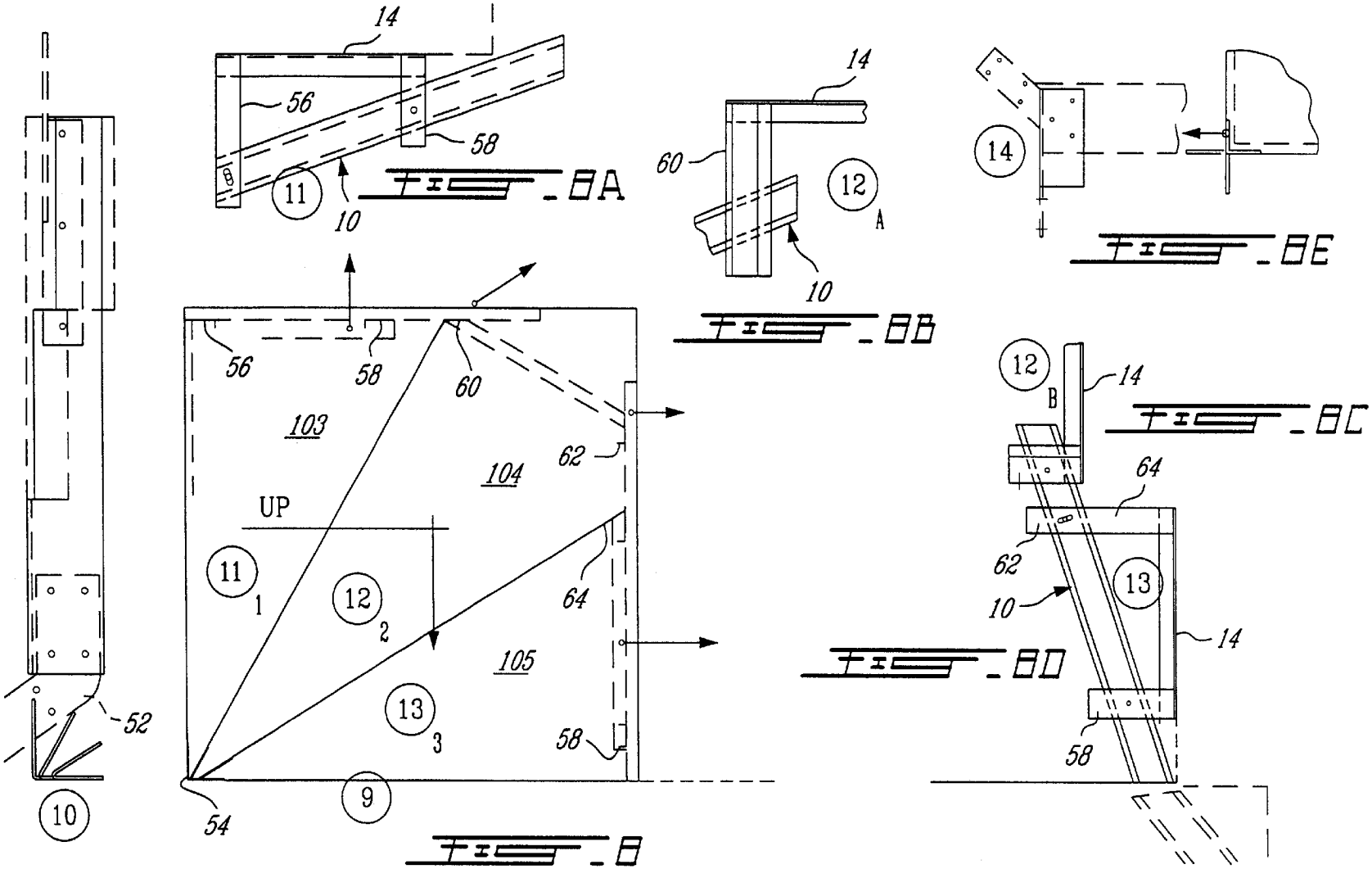
FIGS. 8A to 8E are schematic views of various support structures used in the framing of the angular section of the staircase of FIG. 8.
Figure 9B:
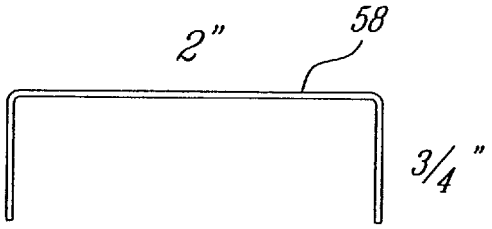
FIGS. 9A to 9E show various brackets used in FIG. 8.
Figure 9A:
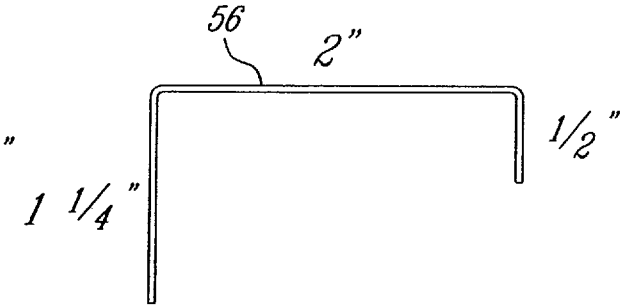
Figure 9E:
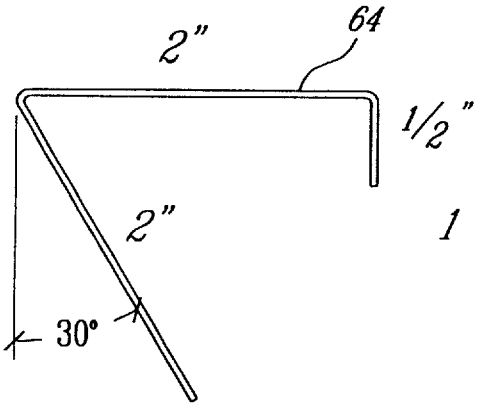
Figure 9D:
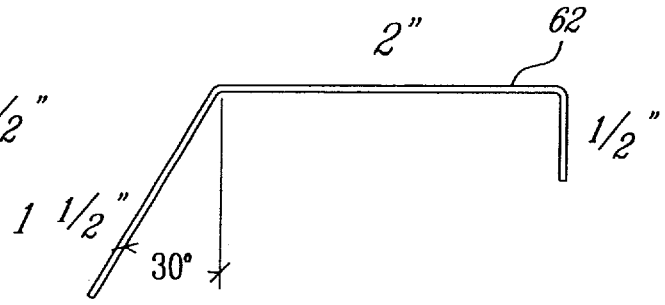
Figure 9C:
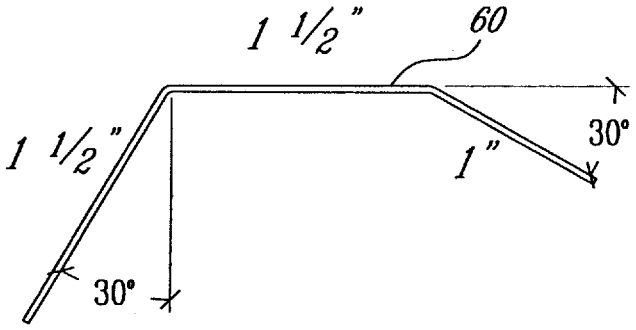

FIG. 8 is a top plan view of the angular section of the staircase S including steps 103, 104 and 105. FIGS. 8A to 8D show various supports and brackets for adjustably connecting the steps 14 and the risers 16 to the stringers 10, including brackets 56, 58, 60, 62 and 64. The brackets 56 to 64 are shown enlarged in FIGS. 9A to 9E, respectively. The brackets 56 to 64 are each made by bending black sixteen-gage steel.

FIG. 8E shows a connection between the stringer and the landing 110.

Therefore, the present kit for erecting a staircase S can be used for a straight staircase as well as for a U-shaped staircase having angular steps and landings. For the exposed side of the staircase, the stringers are attached one to another with rigid connecting systems and are bolted such as to obtain a complete stringer of crankshaft-shape which is self-supporting, the steps and the risers being pre-assembled in a single monocoque unit.

When necessary, such as the free bearing of straight steps exceeds five of six step units, the stringer can be doubled (one upon the other) to reinforce it and to minimize vibrations.

This framing is the only permanent part of the present kit as the steps and risers can be replaced depending on the use of the staircase.

The L-shaped steel units 30 are made from folded steel and are bolted to the adjustable step support 18 to provide a temporary staircase for use during construction, and in the case of a fireproof building, the framing (e.g. the stringers 10) are screwed directly in the concrete walls or other non-flammable facing, and appropriate steel risers and steps (such as the L-shaped units 30) can then be used to obtain a fireproof staircase.

Once at the finishing step of the building, including any cabinet making step, the temporary or provisional steps, i.e. the L-shaped steel units 30, are easily detached from the step supports 18 and replaced by prefabricated units made of solid wood or any other prefabricated elements, these prefabricated units comprising steps 14 and risers 16, preferably made in a single monocoque assembly, and a finishing stringer 28 made of solid wood which nests under the steps 14 and behind the risers 16 in addition to being attached with screws to the metal stringer 10 from inside.

The step supports 18 are made from light steel folded to form flanges 20 and 22 and are each connected to the stringers 10 by two keys 26 capable of sliding in the C-shaped stringers 10 for allowing to shorten or lengthen the span of the steps 14 which varies in view of the height of the risers 16. An additional adjustment is provided by way of the oblong openings 24 which allow for an adjustment of the height of riser 16.

The present stairway system is thus universal in that it allows for the staircase to turn left or right, or remain straight. The corner post 44 for the angular section of the staircase being of different configuration whether the staircase turns right or left.

FIGS. 10 to 22 illustrate a variant staircase S' also in accordance with the present invention. The staircase S' comprises basically a framework 200 and a series of steps 202. The steps 202 can be temporarily mounted to the framework 200 during the construction period and then can take the form of permanent steps. The steps 202 are herein L-shaped and each step 202 includes a horizontal section or tread 204 and a vertical section or riser 206.

The framework 200 includes a series of components, some of which being cut to size in the plant such that all of the components of the framework 200 can be assembled together and installed on site with minimal adjustment, it any. Alternatively, at least part of these components can be assembled together in the plant, perhaps in modular sections, and then installed on site.

More particularly, the framework 200 comprises elongated stringers 208, each typically made of a metallic material or any other suitable material, e.g. composite plastic, capable of sustaining the loads to which it is subjected (including the steps 202 and standard loads to be supported by any staircase), and adjustable step supports 210 mounted inwardly of the stringer 208. The stringers 208 have the configuration of C-shaped channels (see, for instance, FIGS. 16 and 19). The step supports 210 are also each typically made of a metallic material or any other suitable material, e.g. composite plastic, capable of sustaining the loads to which it is subjected (including the steps 202 and standard loads to be supported by any staircase).

Figure 10:
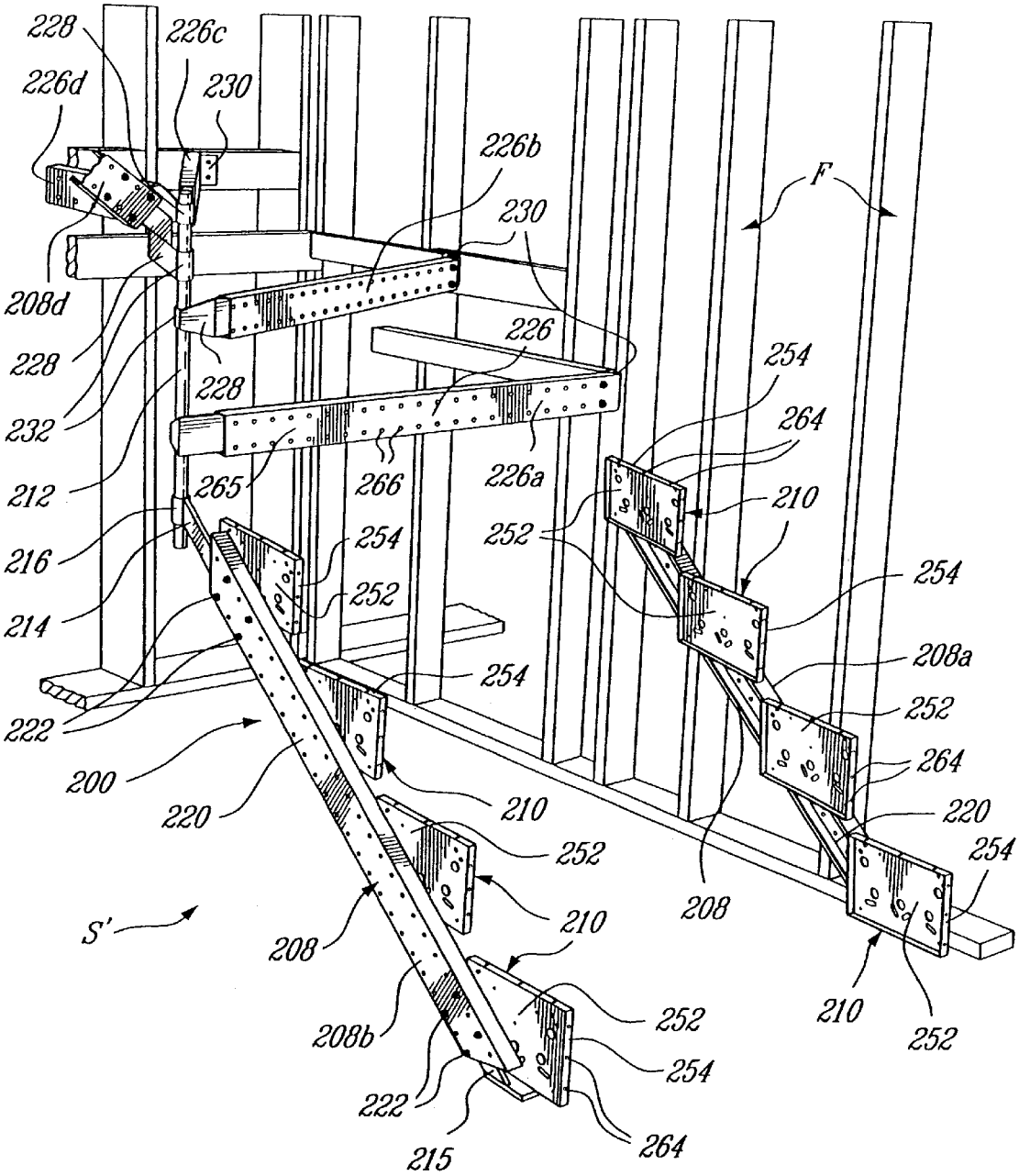
FIG. 10 is a perspective view of a framework of a second embodiment of a staircase also in accordance with the present invention, the framework being shown mounted to a dwelling's wall framework.
Figure 18:
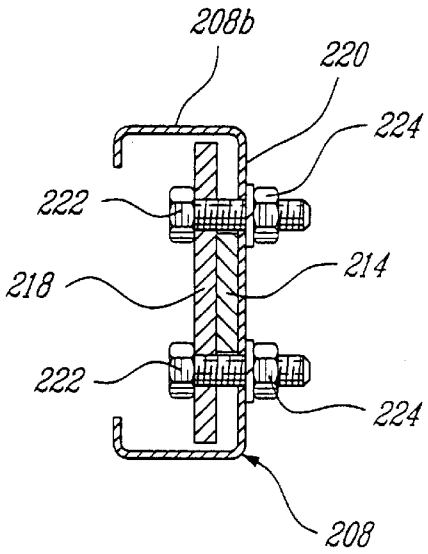
FIG. 18 is a detailed view of part of the framework and showing the assembly of sub-components thereof.
Figure 19:
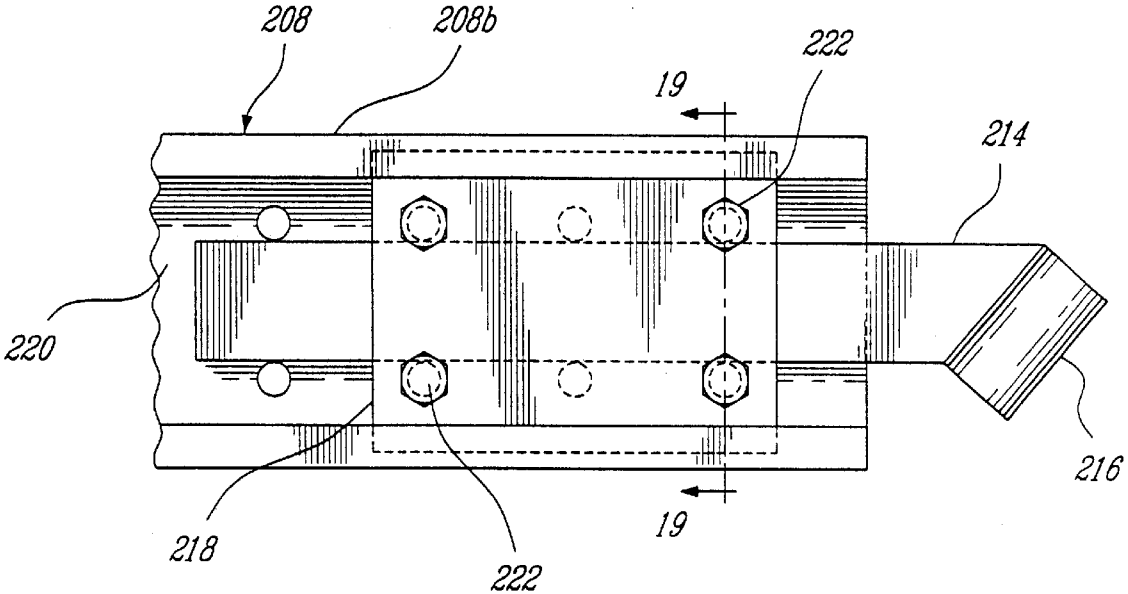
FIG. 19 is a cross sectional view taken along line 19—19 of FIG. 18.
Figure 21:
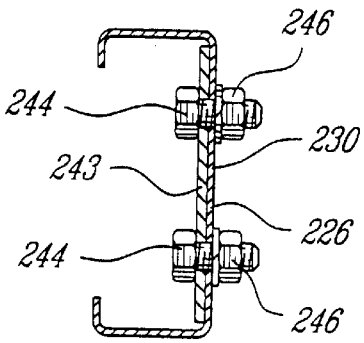
FIG. 21 is a cross sectional view taken along line 21—21 of FIG, 20.

FIG. 10 shows a stringer 208*a* (i.e. a closed stringer) and four step supports 210 fixedly mounted thereto on one side thereof with the other side of the stringer 208*a* being secured to a wooden framework F of the dwelling where the staircase S' is being installed. Facing the stringer 208*a*, there is a stringer 208*b* (i.e. an open stringer) which extends at a location in the dwelling where there is no framework F, whereby the stringer 208*b* must itself be fixedly supported by other means than the framework F. For this purpose, there is provided a vertical post 212 and the stringer 208*b* is secured to a lower end of the post 212 by a link 214. More particularly, the link 214 defines a sleeve 216 at its upper end which is engaged around the post 212 and fixed thereto typically by welding, although these components could be bolted or otherwise attached together. As seen in FIGS. 18 and 19, the link 214 is imprisoned at its lower end between a plate 218 and a web 220 of the stringer 208*b* by way of bolts 222 and nuts 224, the bolts extending through holes defined in the plate 218 and in the web 220 of the stringer 208. A foot member 215, similar to link 214 but with a support plate at is free end instead of sleeve 216, is mounted to the lower end of stringer 208*b* in a way similar to link 214.

Figure 23:
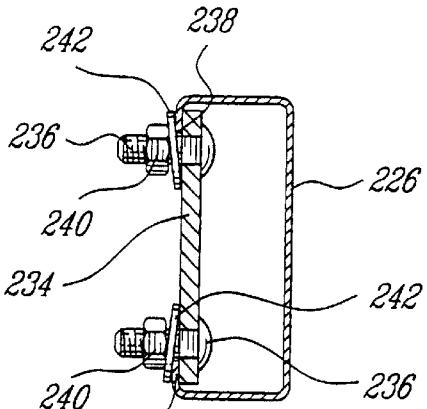
FIG. 23 is a cross sectional view taken along line 23—23 of FIG. 22.
Figure 20:
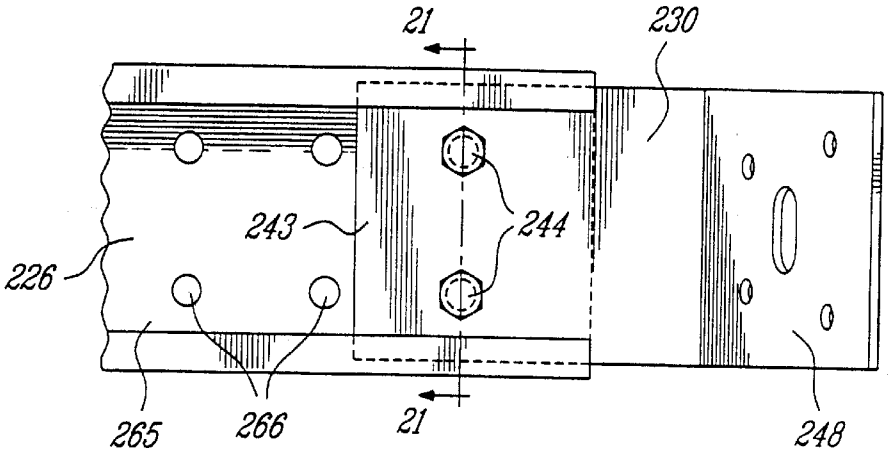
FIG. 20 is a detailed view of part of the framework and showing the assembly of sub-components thereof.
Figure 22:
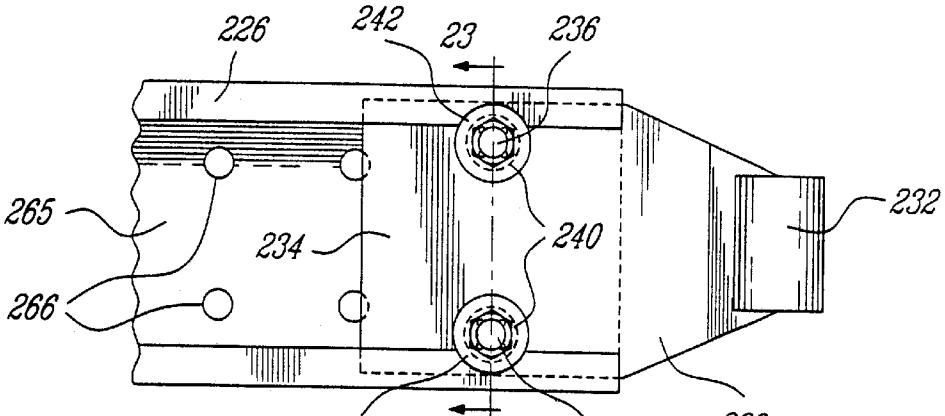
FIG. 22 is a detailed view of part of the framework and showing the assembly of sub-components thereof.

Now returning to FIG. 10, above the stringers 208*a* and 208*b* which are to support four steps 202, the next steps negotiate a 90° turn (see FIG. 14) consisting of three triangular steps which are supported by elongated horizontal supports 226 (i.e. supports 226*a*, 226*b*, 226*c* and 226*d*) which resemble the stringers 208. The outside ends of these horizontal supports 226 are secured in position to the framework F with similarly configured plates 230 (best seen in FIGS. 20 and 21) and their inside ends are secured to the post 212 using a series of similarly configured links 228 (best seen in FIGS. 22 and 23).

More particularly, each link 228 includes at one end a sleeve 232 surrounding the post 212 and welded thereto, and at an opposite end a flat section 234 defining holes though which extend bolts 236 with the flat section 234 being retained to the horizontal support 226 by it being urged towards the inside of lips 238 of the horizontal support 226 by the bolts 236 which coact with nuts 240 and washers 242 which bear against the outside of the lips 238. It is noted that both the horizontal supports 226*c* and 226*d* are mounted to the post 212 with a single link 228 which has one sleeve 232 and two flat sections 234, i.e. one for connection to each horizontal support 226*c*, 226*d*.

Each plate 230 has an inner end 243 secured to the inside of the horizontal support 226 (see FIGS. 20 and 21) by way of bolts 244 and nuts 246, and an outer end 248 angled with respect to the inner end 243 such as to bear against the framework F and held thereto with screws, or the like, driven through holes defined in the outer end 248.

Figure 13:
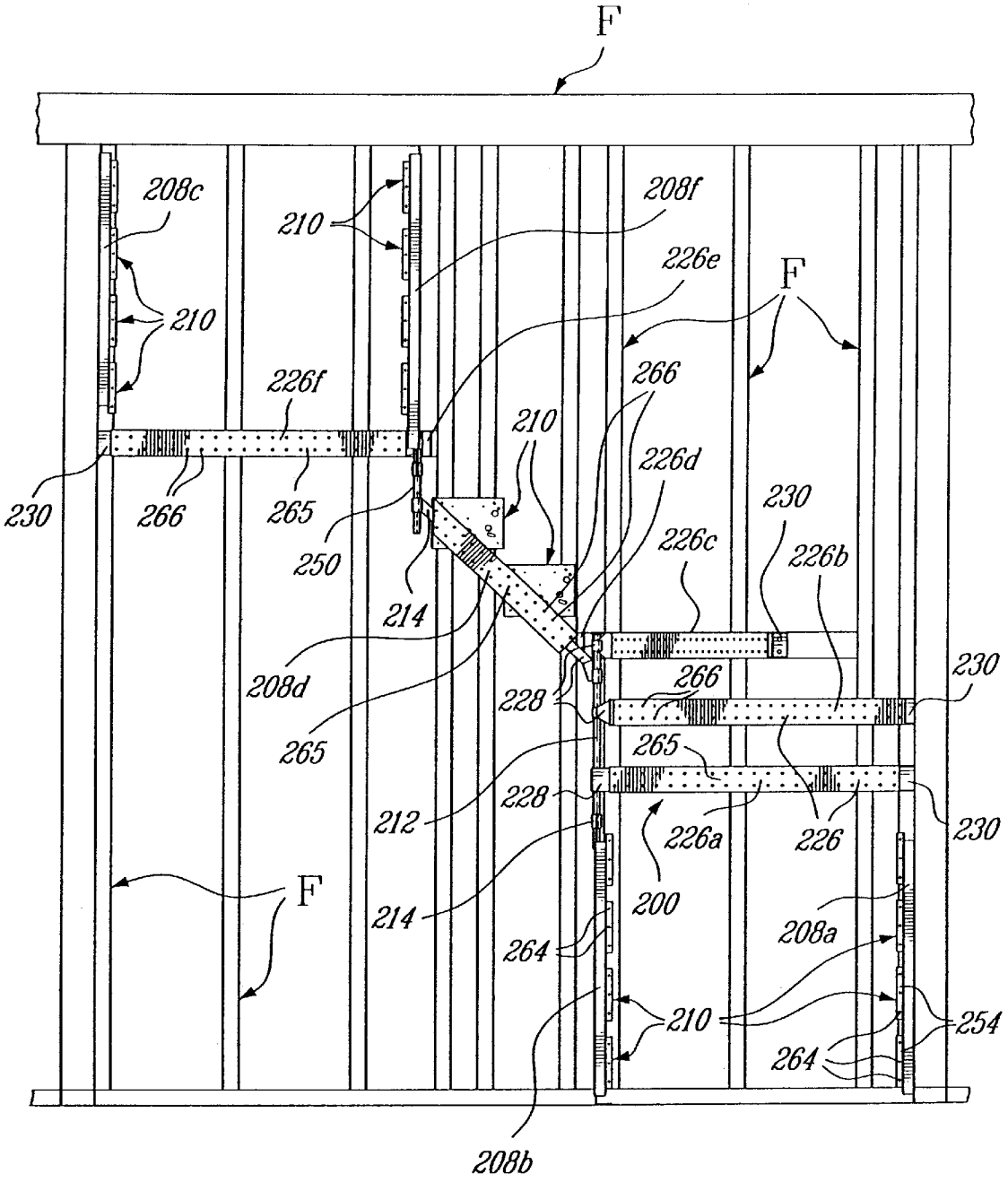
FIG. 13 is a front elevational view of the framework of FIG. 10 which also shows additional upper components of the framework.
Figure 14:
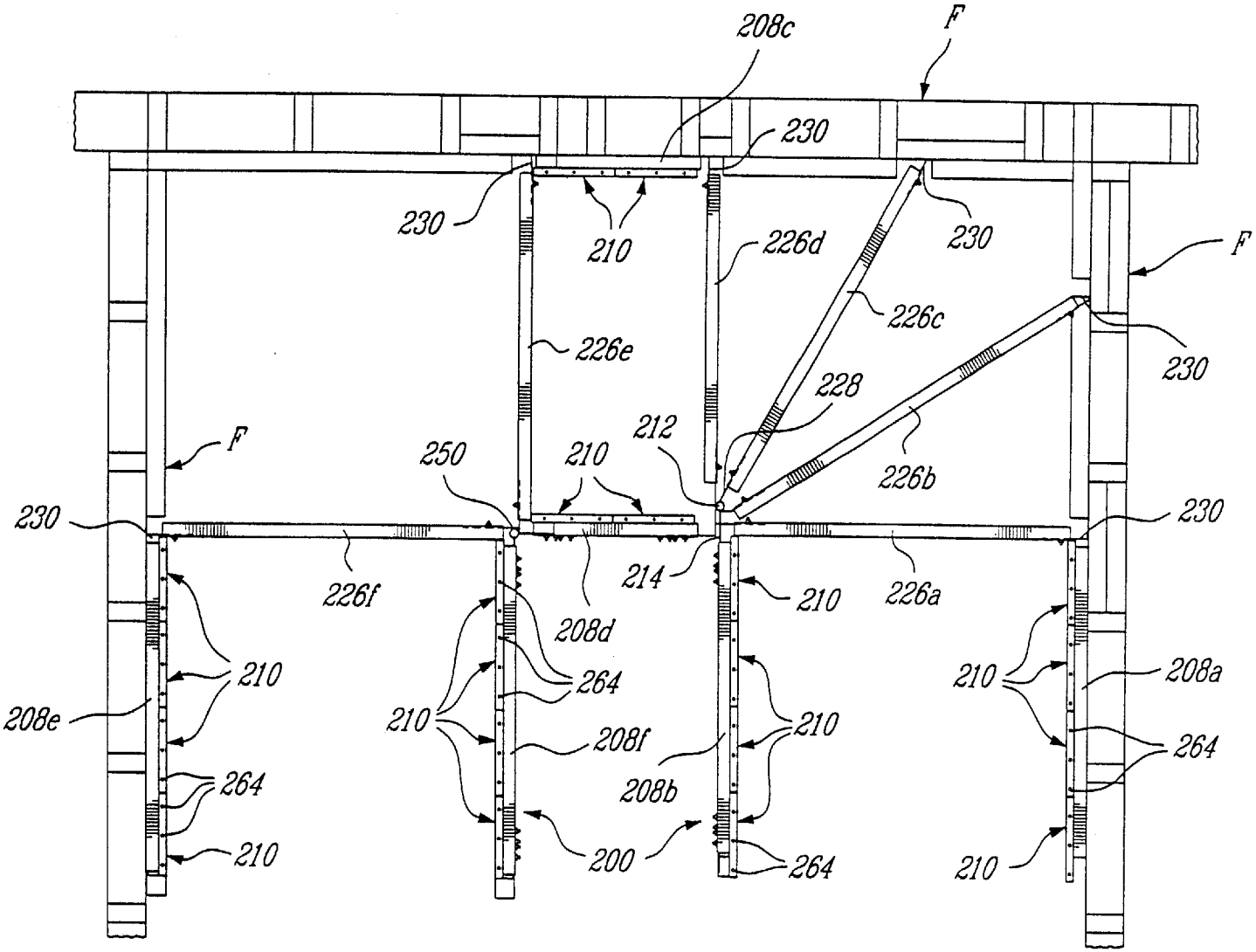
FIG. 14 is a top plan view of the framework of FIG. 13.

As best seen in FIGS. 13 and 14, the two next steps are supported by stringers 208*c* and 208*d* and two step supports 210 are mounted to each of these stringers. Stringer 208*c* is mounted to the framework F, whereas stringer 208*d* is supported at its lower end by the post 212 (using a further link 228) and its upper end by a further post 250 which is similar in configuration and identical in function to the post 212.

A pair of further horizontal supports 226 (i.e. supports 226*e* and 226*f*) are mounted, as the earlier supports, at their outside ends to the framework P (using plates 230) and at their inside ends to post 250. The two supports 226*e* and 226*f* are at a same level such that the staircase S' defines therebetween a landing area.

Then, two stringers 208*e* and 208*f* extend parallelly upwardly from the horizontal support 226*f* and four step supports 210 are mounted to each of these two stringers 208*e* and 208*t* for providing four straight steps above the landing area which are similar to the steps supported by the bottom stringers 208*a* and 208*b*.

It is noted that, even though the present posts 212 and 250 have been herein illustrated with circular cross-sections, these posts may also be of different tubular shapes, e.g. of square cross-section. Also, the sleeves 216 and 232 respectively of links 214 and 228 can, aside from being welded to the posts 212 and 250, be secured alternatively be attached thereto on site by way, for instance, of set screws extending radially through the sleeves 216/232 and into the wall of the posts 212 and 250 thereby allowing for on site positioning and/or adjustment of the links 214/228 to the posts 212/250. In such a case, the posts 212/250 would define a series of threaded holes disposed vertically therealong for allowing the links 214/228 to be adjusted height-wise on site relative to the posts 212/250.

Therefore, the framework 200 generally consists, for straight runs, of stringers 208 provided with step supports 210; for angled runs, of horizontal supports 226*a* to 226*d*; and, for landing areas, of a pair of horizontal supports 226*e* and 226*f*. The stringers 206 and horizontal supports 226 are mounted at their closed end to the dwelling's framework F and at their open end to the posts 212 and 250 and the latter are maintained in position by their rigid connections to the horizontal supports 226 and to the stringers 208 which are themselves firmly and safely anchored to the framework F. The free ends of the stringers (i.e. lower ends of stringers 208*a* and 208*b* and upper ends of stringers 208*e* and 208*f*) may be secured to the dwelling's floor structure.

Figure 15:
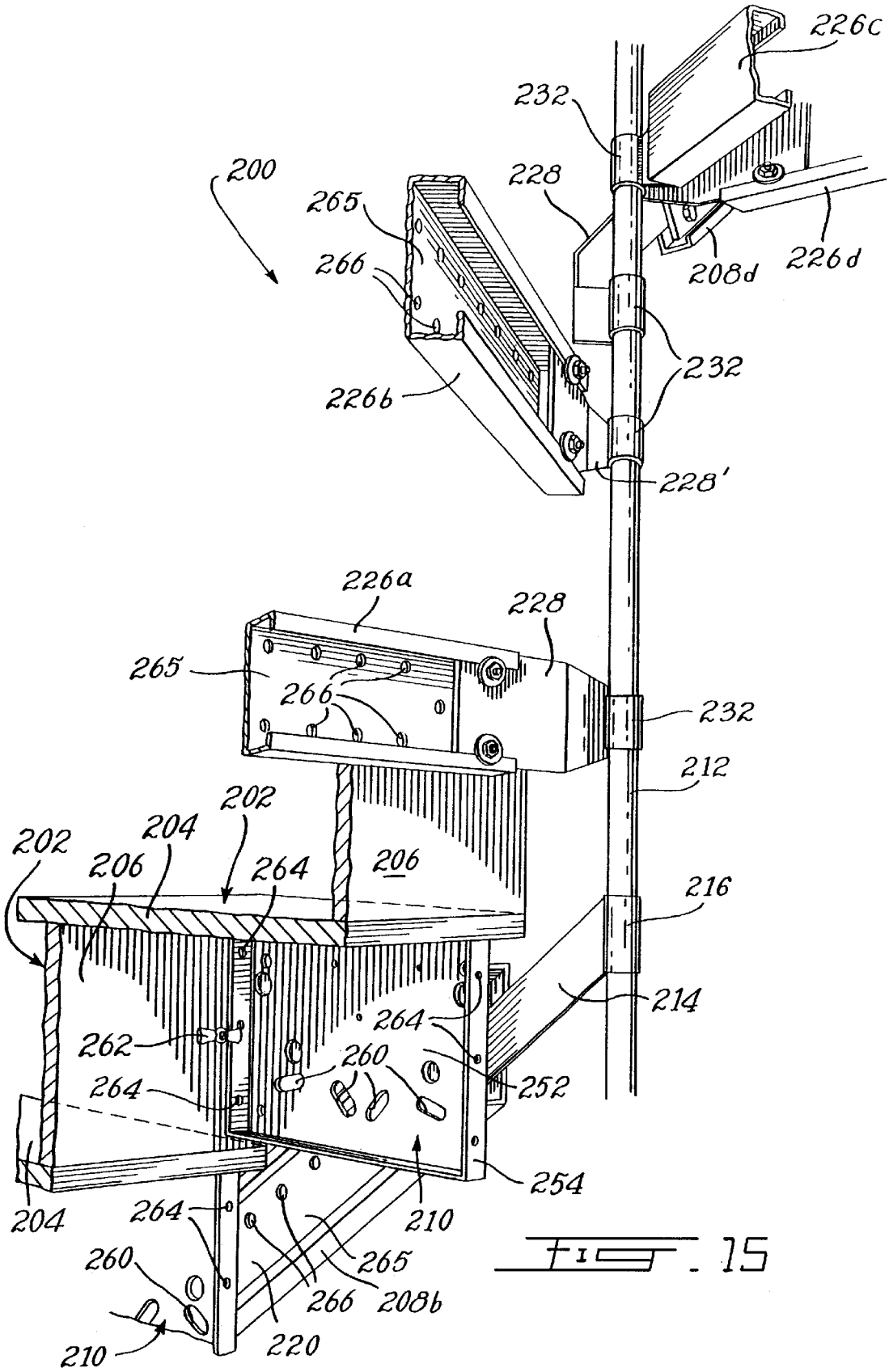
FIG. 15 is a bottom perspective detailed view of part of the framework and of the steps of FIG. 12.
Figure 16:
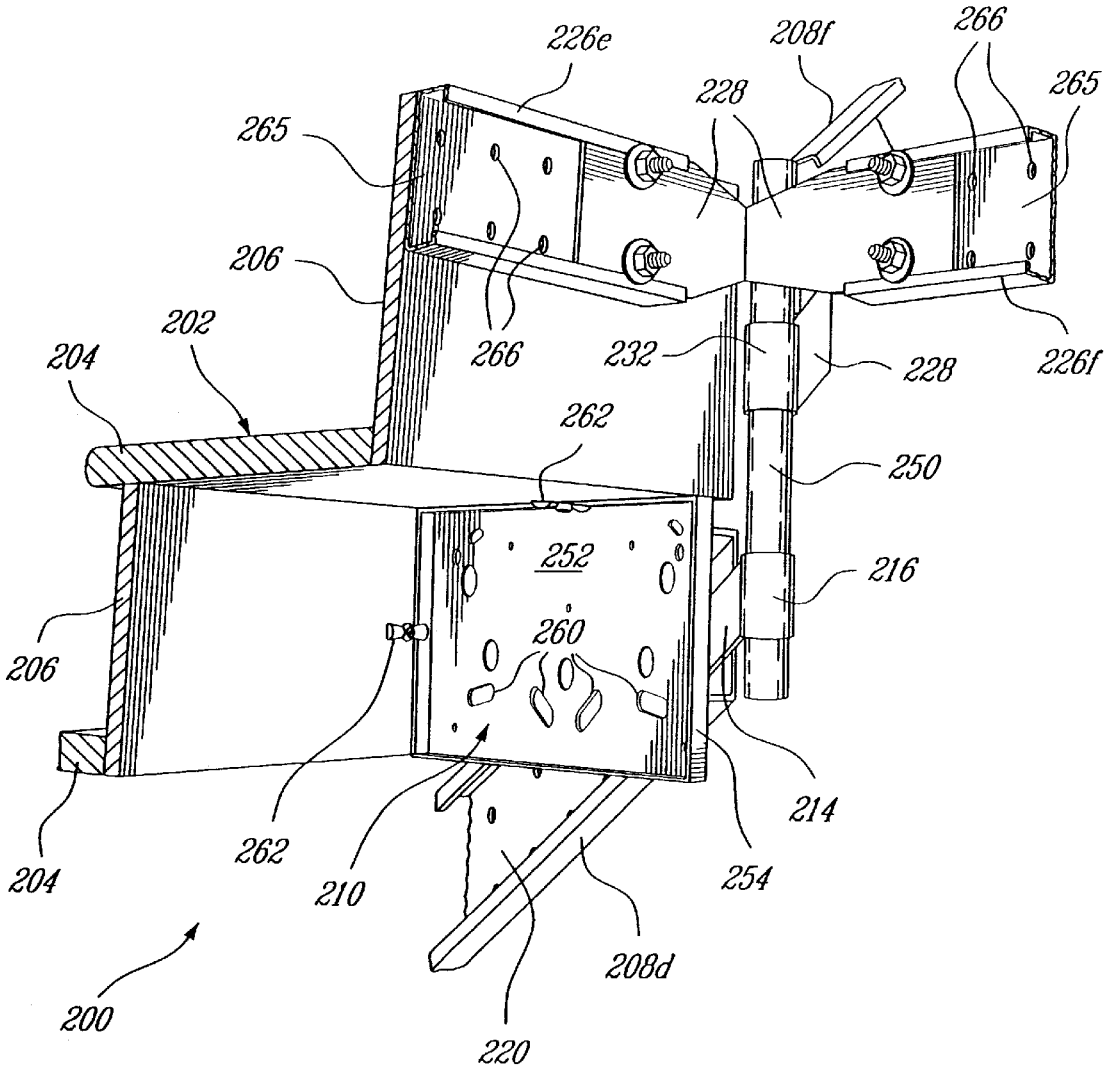
FIG. 16 is a bottom perspective detailed view of another part of the framework and of the steps of FIG. 12.
Figure 17:
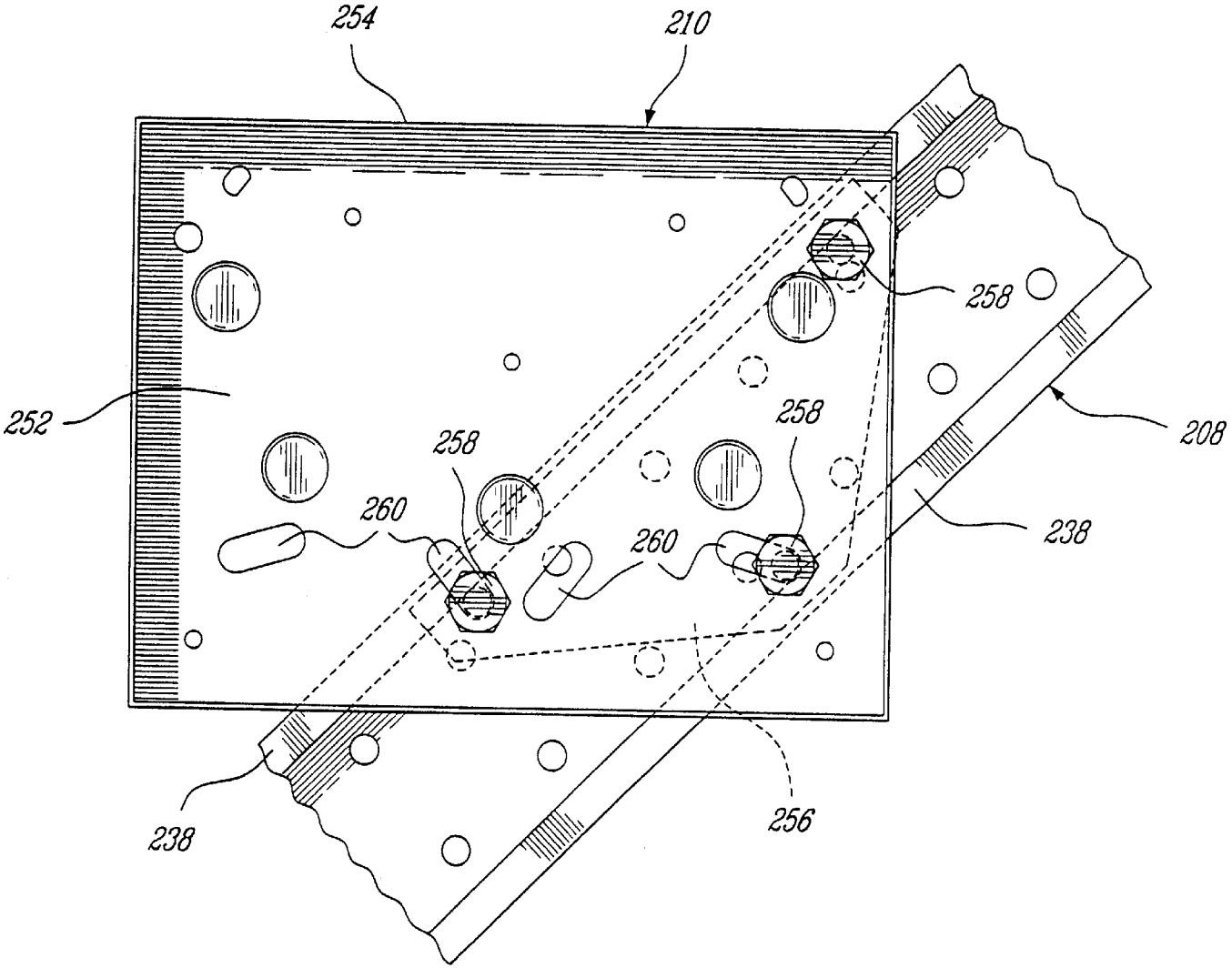
FIG. 17 is an elevational detailed view of a part of the framework and showing the assembly of sub-components thereof.

As seen in FIGS. 15 to 17, the step supports 210 each have a rectangular shaped body 252 with perpendicular flanges 254 extending peripherally therefrom. The steps supports 210 may be welded to the stringers 208 or may secured thereto with a plate 256 (see FIG. 17) located inside the stringer 208 and bolt and nut arrangements 258 extending through the plate 258 and through the body 252, the lips 238 of the stringer 208 being sandwiched between the plate 256 and the body 252 such that the step support 210 is held firmly against the stringer 208. The step support 210 defines oblong holes 260 for allowing different relative positions between the step support 210 and the stringer 208 thereby allowing for steps of different tread depths and riser heights. Also, the step support 210 has a generally symmetric configuration (e.g. at the level of its oblong holes 260) such that it can be used on either left-hand or right-hand stringers, e.g. stringers 208*b* and 208*a*, respectively.

The steps 202 can be attached in different ways to the step supports 210 and horizontal supports 226. For instance, in FIG. 15, the flange 254 of the step support 210 is secured to the riser 206 of the step 202 by a wing nut 262 screwed to the riser 206 and engaging the flange 254 with one of its wings. Also, screws could be driven through openings 264 defined in the flanges 254 and into the back of the step 202. Glue could also be used to secure the step 202 to the flanges 254.

The steps 202 can be similarly secured to the horizontal supports 226 by using glue as in FIGS. 15 and 16 where webs 265 of the supports 226 bear against the risers 206 of the steps 202. Screws can also be driven through openings 266 defined in the webs 265 and into the steps 202.

Conveniently, when temporary steps are installed in the staircase S', easily releasable means (such as wing nuts 262) are preferably used to mount the steps 202 to the framework 200. The permanent steps can then be mounted to the framework using these same releasable means and/or other means (e.g. glue, screws, etc.).

The above components are preferably all manufactured to size in the plant as opposed as on the site, and this can be done by having the dimensions of the staircase to be installed. The components can be all assembled on site as a kit, or can be assembled in one or more modular sections to finally assembled together on site, It is convenient to fixedly mount in plant the components which depend from the posts (212, 250); similarly, it is preferable to fix the step supports 210 to the stringers 208 in the plant. If possible, the whole assembled framework 200 is permanently produced in the plant such that only the connections thereto with the dwelling's framework F are effected on site.

The components of the framework 200 must be sufficiently rigid and strong to sustain the loads to which they are subjected, including the weight of some of the components of the framework 200 itself, the weight of the steps 202 and the weight that the staircase S' must be able to support.

Figure 11:
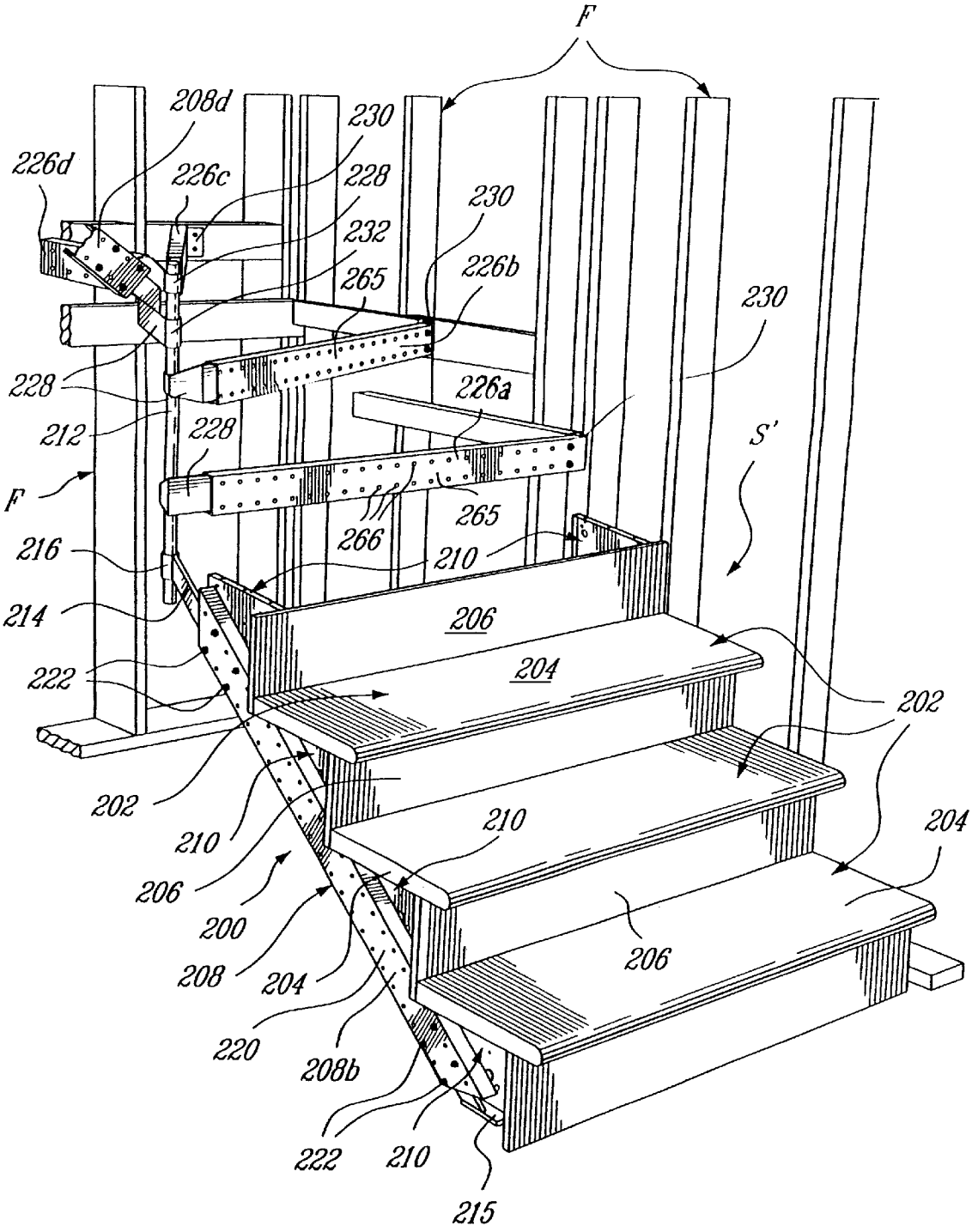
FIG. 11 is a perspective view similar to FIG. 10 but showing some of the staircase's steps mounted to the framework.
Figure 12:
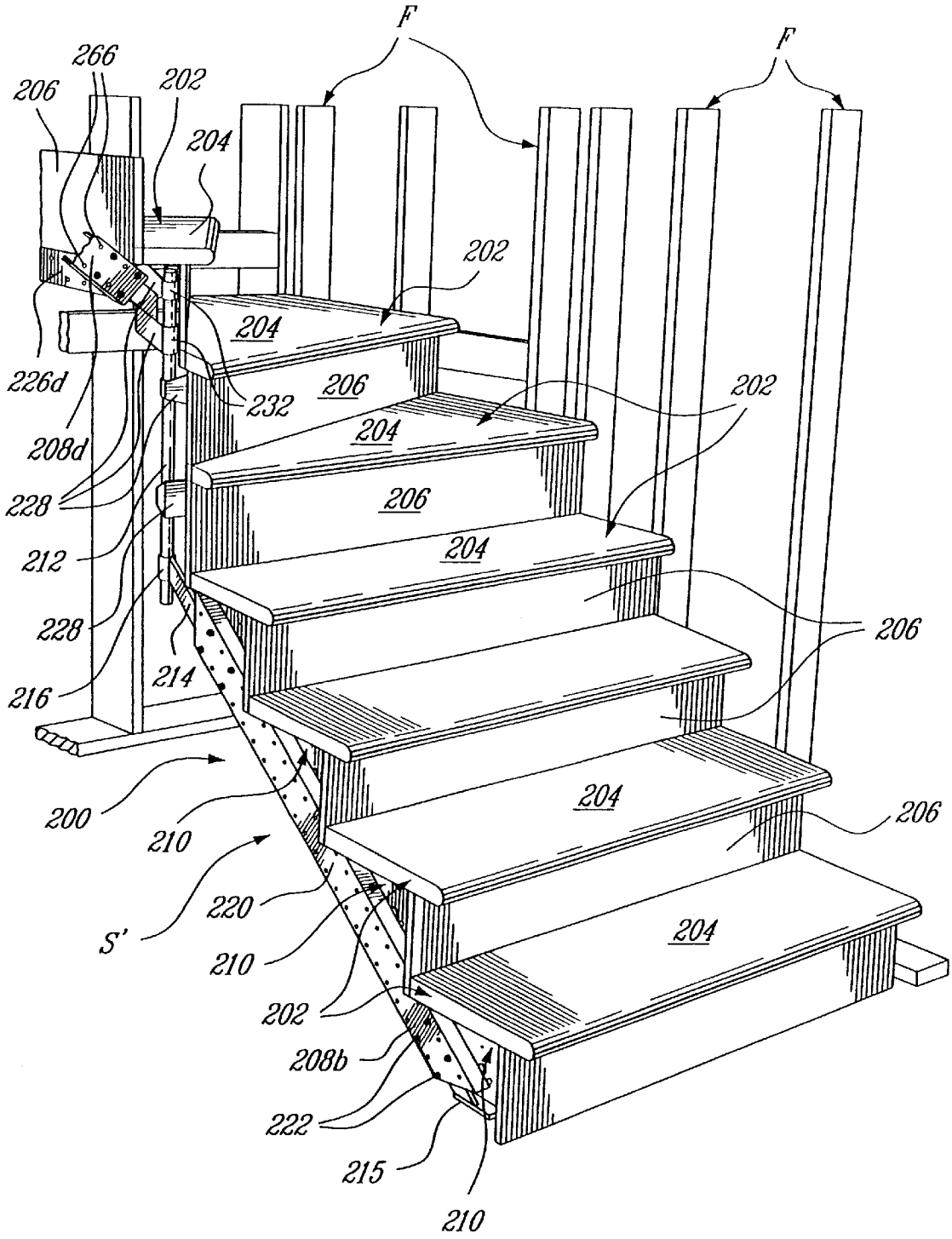
FIG. 12 is a perspective view similar to FIG. 11 but showing more of the staircase's steps mounted to the framework.

If both the stringers 108*a* and 108*b* are of the closed type, they will both be secured to the framework F as stringer 108*a* of FIGS. 10 to 12. Similarly, if both sides of the staircase S' are closed, the posts 212 and 250 may not be required as framework F will be present to support the stringers 208 as well the both ends of each horizontal support 226.

The present system offers a great economy in wood as the framework 200 is generally all made of metallic material (with rigid and strong plastics being also usable), and the use of such a metallic framework 200 provides generally more rigidity to the staircase S' . The present connections between the framework 200 and the steps most likely reduces squeaking in the staircase S'.

What is claimed is:

1. A modular framework for a staircase, comprising at least two non-wooden stringers and a series of non-wooden step supports adapted to be mounted to the stringers for supporting a number of steps when the stringers are installed in a dwelling, wherein said step supports are installed to said stringers at predetermined locations therealong such that the steps can be directly mounted to said step supports and into proper position thereof for the staircase, wherein said step supports each include upper and front ends adapted to be secured respectively to an underside of a tread of a step and to a back side of a riser thereof, wherein said step support includes a body adapted to be mounted to said stringer and at least one flange defining said upper and front ends and adapted to be mounted to the steps, and wherein at least one pivotable clip is provided for securing said flange to the step.

2. A framework as defined in claim 1, wherein said flange defines a series of openings for allowing the step to be anchored to said step support with screws engaged through said openings and into the hidden side of the step.

3. A modular framework for a staircase, comprising at least two non-wooden stringers and a series of non-wooden step supports adapted to be mounted to the stringers for supporting a number of steps when the stringers are installed in a dwelling, wherein said step supports are installed to said stringers at predetermined locations therealong such that the steps can be directly mounted to said step supports and into proper position thereof for the staircase, wherein an upper end of at least one of said stringers is supported by a lower end of at least one vertical post said vertical post being anchored to a framework of the dwelling with at least one horizontal support.

4. A framework as defined in claim 3, wherein said stringers, said step supports and said vertical and horizontal supports are made of at least one metallic material.

5. A modular framework for a staircase, comprising at least two non-wooden stringers and a series of non-wooden step supports adapted to be mounted to the stringers for supporting a number of steps when the stringers are installed in a dwelling, wherein said step supports are installed to said stringers at predetermined locations therealong such that the steps can be directly mounted to said step supports and into proper position thereof for the staircase, wherein an upper end of at least one of said stringers is supported by at least one vertical support, said vertical support being anchored to a framework of the dwelling with at least one horizontal support, wherein said vertical support comprises at least one post, and wherein a number of said horizontal support is mounted to said post such as to extend therefrom at different angles for supporting a landing area of the staircase.

6. A modular framework for a staircase, comprising at least two non-wooden stringers and a series of non-wooden step supports adapted to be mounted to the stringers for supporting a number of steps when the stringers are installed in a dwelling, wherein said step supports are installed to said stringers at predetermined locations therealong such that the steps can be directly mounted to said step supports and into proper position thereof for the staircase, wherein an upper end of at least one of said stringers is supported by at least one vertical support, said vertical support being anchored to a framework of the dwelling with at least one horizontal support, wherein said vertical support comprises at least one post, and wherein a number of said horizontal support is mounted at various elevations to said post such as to extend therefrom with different angles for supporting a number of angular steps of the staircase.

7. A modular framework for a staircase, comprising at least two non-wooden stringers and a series of non-wooden step supports adapted to be mounted to the stringers for supporting a number of steps when the stringers are installed in a dwelling, wherein said step supports are installed to said stringers at predetermined locations therealong such that the steps can be directly mounted to said step supports and into proper position thereof for the staircase, wherein an upper end of at least one of said stringers is supported by at least one vertical support, said vertical support being anchored to a framework of the dwelling with at least one horizontal support, and wherein said horizontal support is secured to said vertical support with at least one-first link and to the framework with at least one second link.

8. A framework as defined in claim 7, wherein said first link comprises at a first end thereof a sleeve engaged around said vertical support and secured thereto and at a second end thereof a plate section secured to said horizontal support.

9. A framework as defined in claim 7, wherein said second link comprises a pair of plate sections appropriately angled to one another for respective connection to said horizontal support and the framework of the dwelling.

10. A framework as defined in claim 7, wherein bolt and nut arrangements are used to secure said first and second links to said horizontal support.

11. A modular framework for a staircase, comprising at least two non-wooden stringers and a series of nonwooden step supports adapted to be mounted to the stringers for supporting a number of steps when the stringers are installed in a dwelling, wherein said step supports are installed to said stringers at predetermined locations therealong such that the steps can be directly mounted to said step supports and into proper position thereof for the staircase, wherein an upper end of at least one of said stringers is supported by at least one vertical support, said vertical support being anchored to a framework of the dwelling with at least one horizontal support, and wherein said horizontal support defines a series of openings for allowing the step to be anchored to said horizontal support with screws engaged through said openings and into the hidden side of the step.

12. A modular framework for a staircase, comprising at least two non-wooden stringers and a series of non-wooden step supports adapted to be mounted to the stringers for supporting a number of steps when the stringers are installed in a dwelling, wherein said step supports are installed to said stringers at predetermined locations therealong such that the steps can be directly mounted to said step supports and into proper position thereof for the staircase, further comprising at least one set of steps adapted to be attached to said framework, wherein there are provided first temporary and second finished sets of steps, each step including at least a tread adapted to be secured to said step support, said steps of said temporary set being detachably attached to said step supports, wherein during construction said first set of steps are temporarily attached to said step supports, whereas at the end of construction said first set of steps are replaced by said second set of steps which are permanently secured to said-step supports.

13. A kit for erecting a staircase in a dwelling, comprising at least two stringers, a series of step supports adapted to be mounted to the stringers, and at least a first set of steps adapted to be mounted to said step supports when said stringers and said step supports are installed in a dwelling; wherein said step supports are installed to said stringers at predetermined locations therealong such that the steps can be directly mounted to said step supports and into proper position thereof for the staircase, wherein there are provided first temporary and second finished sets of steps, each step including at least a tread adapted to be secured to said step support, said steps of said temporary set being detachably attached to said step supports, wherein during construction said first set of steps are temporarily attached to said step supports, whereas at the end of construction said first set of steps are replaced by said second set of steps which are permanently secured to said step supports.

14. A kit as defined in claim 13, wherein each said step of at least said second set of steps comprises a riser mounted to a respective tread thereof in a way such that each step of said second set is modular.

15. A kit as defined in claim 13, further comprising at least one horizontal support for securing at least one stringer and at least one step to a framework of the dwelling.

16. A kit for erecting a staircase in a dwelling, comprising at least two stringers and at least first temporary and second finished sets of steps, each step including at least a tread, said stringers being adapted for supporting said steps and being detachably attached thereto, wherein during construction said first set of steps are temporarily attached to said stringers and are subsequently replaced by said second set of steps which are secured to said stringers.

17. A kit as defined in claim 16, wherein said step of said first temporary set also includes a riser, said step of said first set being made of a metallic material.

18. A kit as defined in claim 17, wherein said tread and said riser of each said step of said first set are integrally joined in an L-shaped configuration made by folding a metal sheet.

19. A kit as defined in claim 16, wherein each said stringer comprises an elongated member and a series of step supports adapted to be secured to said elongated member, said steps being adapted to be mounted to said step supports.

20. A kit as defined in claim 19, wherein said step also includes a riser, each said step support defining upper and front ends adapted to be secured respectively to an underside of said tread and to a back side of said riser.

21. A kit as defined in claim 20, wherein said elongated member comprises a C-shaped channel, and wherein said step supports are adjustably mounted to said channel.

22. A kit as defined in claim 16, further comprising a finished stringer for attachment to an exposed side of said staircase and outwardly of said stringer.

23. A method of erecting a staircase in a dwelling, comprising the steps of:

a) providing at least two stringers and first temporary and second finished sets of steps;

b) installing said stringers to a framework of the dwelling;

c) mounting the temporary set of steps to the stringers;

d) removing the temporary set of steps from the stringers at the end of a construction process; and e) mounting the finished set of steps to the stringers.

24. A kit for erecting a staircase in a dwelling, comprising at least two stringers and at least first temporary and second finished sets of steps, each step including at least a tread, said stringers being adapted for supporting said steps and being detachably attached thereto, wherein said first set of steps are temporarily attached to said stringers and are subsequently replaced by said second set of steps which are secured to said stringers, wherein each said stringer comprises an elongated member and a series of step supports adapted to be secured to said elongated member, said steps being adapted to be mounted to said step supports and each including a riser, each said step support defining upper and front ends adapted to be secured respectively to an underside of said tread and to a back side of said riser.

25. A kit for erecting a staircase in a dwelling, comprising at least two stringers and at least first temporary and second finished sets of steps, each step including at least a tread, said stringers being adapted for supporting said steps and being detachably attached thereto, wherein said first set of steps are temporarily attached to said stringers and are subsequently replaced by said second set of, steps which are secured to said stringers, and further comprising a finished stringer for attachment to an exposed side of said staircase and outwardly of said stringer.

* * * * *